US006703914B1

(12) United States Patent
Rogers, Sr. et al.

(10) Patent No.: US 6,703,914 B1
(45) Date of Patent: Mar. 9, 2004

(54) DEFLECTION COIL HAVING GAPS FORMED SUBSEQUENT TO THE WINDING

(75) Inventors: Donald N. Rogers, Sr., Temecula, CA (US); Basab Bijay Dasgupta, San Clemente, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 464 days.

(21) Appl. No.: 09/770,354

(22) Filed: Jan. 11, 2001

(51) Int. Cl.[7] ..... H01H 1/00; H01H 5/00
(52) U.S. Cl. ..... 335/213
(58) Field of Search ..... 335/210–214; 313/440

(56) References Cited

U.S. PATENT DOCUMENTS 4,612,525 A * 9/1986 Sluyterman et al. ..... 335/213
4,754,248 A 6/1988 Belica ..... 335/210
5,373,274 A 12/1994 Belica et al. ..... 335/213
5,988,554 A 11/1999 Taka ..... 242/433.1

* cited by examiner

*Primary Examiner*—Ramon M. Barrera
(74) *Attorney, Agent, or Firm*—Blakely, Sokoloff, Taylor & Zafman LLP

(57) ABSTRACT

A method and a related apparatus are described for forming gaps into a saddle-shaped deflection coil subsequent to a winding process. The method includes winding a conductive wire into a saddle-shaped deflection coil using a winding machine and bonding the saddle-shaped deflection coil to provide adhesive bonding between winding turns of the coil while the coil remains in the winding machine. Then, the deflection coil is removed from the winding machine and heat is applied to the deflection coil after the deflection coil has been removed from the winding machine to a temperature above a first temperature and below a second temperature. Gaps are formed in the deflection coil subsequent to the winding process while the temperature of the coil is between the first and second temperatures.

8 Claims, 6 Drawing Sheets

DEFLECTION COIL HAVING GAPS FORMED SUBSEQUENT TO THE WINDING

BACKGROUND OF THE INVENTION

1. Field of the Invention

The present invention generally relates to deflection coils for cathode;ray tubes, and in particular, to an apparatus and a related method of forming gaps in a deflection coil.

2. Description of the Related Art

Cathode ray tubes (CRTs) are used in display devices to produce images. The basic elements of a CRT are a deflection yoke, one or more electron guns, and a phosphor screen. The deflection yoke converges and deflects electron beams emitted by the electron gun(s). In general, a deflection yoke include two pairs of coils, where the first coil pair (i.e., horizontal coil) deflects the electron beam in the horizontal direction and the second coil pair (i.e., vertical coil) deflects that same electron beam in the vertical direction.

One type of a deflection coil used in deflection yokes is a saddle-type deflection coil 100 as shown in FIG. 1. Typically, a coil-winding die and a winding machine are used to winding a conductive wire into a saddle-shaped coil. The conductive wire generally includes an insulation layer and an adhesive coating disposed about the insulation layer. After the conductive wire has been wound into a proper shape, the coil is heated to melt the adhesive coating and provide adhesive bonding between winding turns of the coil.

As the requirements of deflection yokes become more stringent, deflection coils take on more complicated and intricate winding patterns as shown in FIG. 2. The number, location and shape of the gaps in the deflection coil influence the magnetic field produced by the coil. One conventional method of forming gaps in a deflection coil requires the use of pin insertions in the die during winding. At various times during the winding process, the coil-winding die stops spinning momentarily to enable pins to be inserted in the winding area. After the pins have been inserted, the coil-winding die starts to spin again to wind the wire around the inserted pins. The pin insertions cause the path of the winding to change. By changing the path of the winding, gaps are formed between a previous winding path and a subsequent winding path. The timing of the pin insertions and the location of the pin inserting mechanisms incorporated into the coil-winding die dictate the location of gaps formed in a deflection coil. Gaps in a deflection coil produced by inserting pin mechanisms during a winding process are usually of a triangular or curved triangular shape, as shown in FIG. 2.

Such conventional method of forming gaps in a deflection coil during a winding process suffers from various disadvantages. For example, because pin inserting mechanisms are permanently incorporated into the coil-winding die and the winding machine, the pin inserting mechanisms increase the complexity of the die design and increase the cost of designing and producing the die and winding machine. Moreover, because pins are inserted during winding of the deflection coil, the coil-winding die must slow down or stop spinning momentarily to enable pins to be inserted during a winding process. As a result the winding process is slowed down and the production output rate is reduced. Furthermore, the shape, location, and number of gaps in the deflection coils are restricted to those already machined into the coil-winding die. In other words, if a design engineer decides to change the location of one or more gaps in a deflection coil, this would require making major design changes in the winding machine and the coil-winding die.

SUMMARY OF THE INVENTION

In accordance with one embodiment of the present invention, a method is provided for forming gaps into a saddle-shaped deflection coil subsequent to a winding process. The method includes winding a conductive wire into a saddle-shaped deflection coil using a winding machine and bonding the saddle-shaped deflection coil to provide adhesive bonding between winding turns of the coil while the coil remains in the winding machine. Then, the deflection coil is removed from the winding machine and heat is applied to the deflection coil after the deflection coil has been removed from the winding machine to a temperature above a first temperature and below a second temperature. Gaps are formed in the deflection coil subsequent to the winding process while the temperature of the coil is between the first and second temperatures.

DETAILED DESCRIPTION OF THE INVENTION

Figure 1:
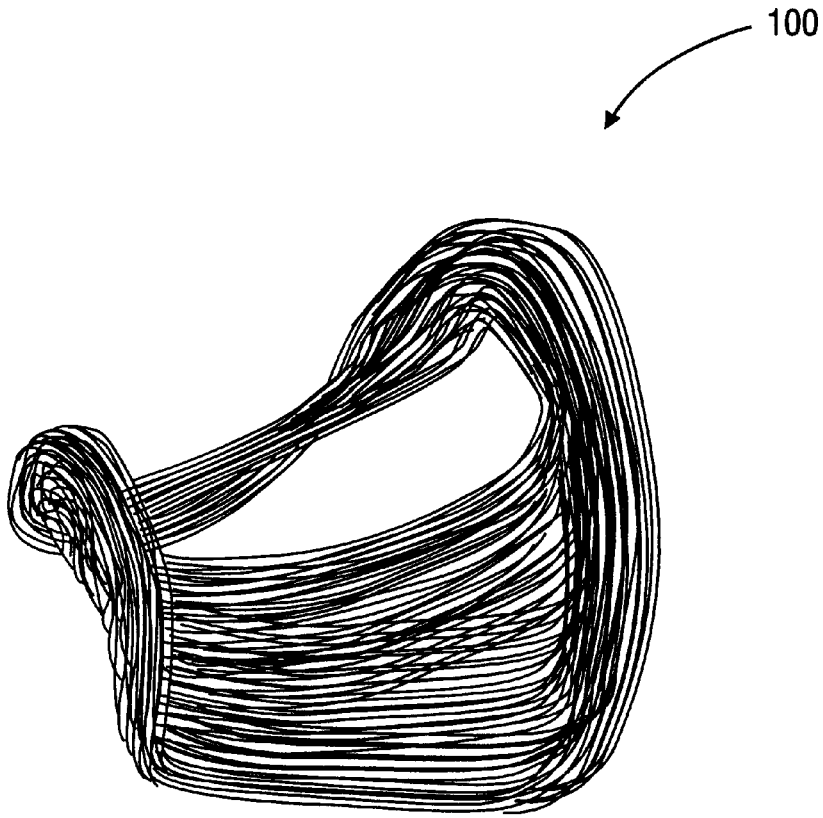
FIG. 1 (PRIOR ART)
FIG. 1 is a diagrammatic perspective view of a conventional saddle-type deflection coil.
Figure 2:
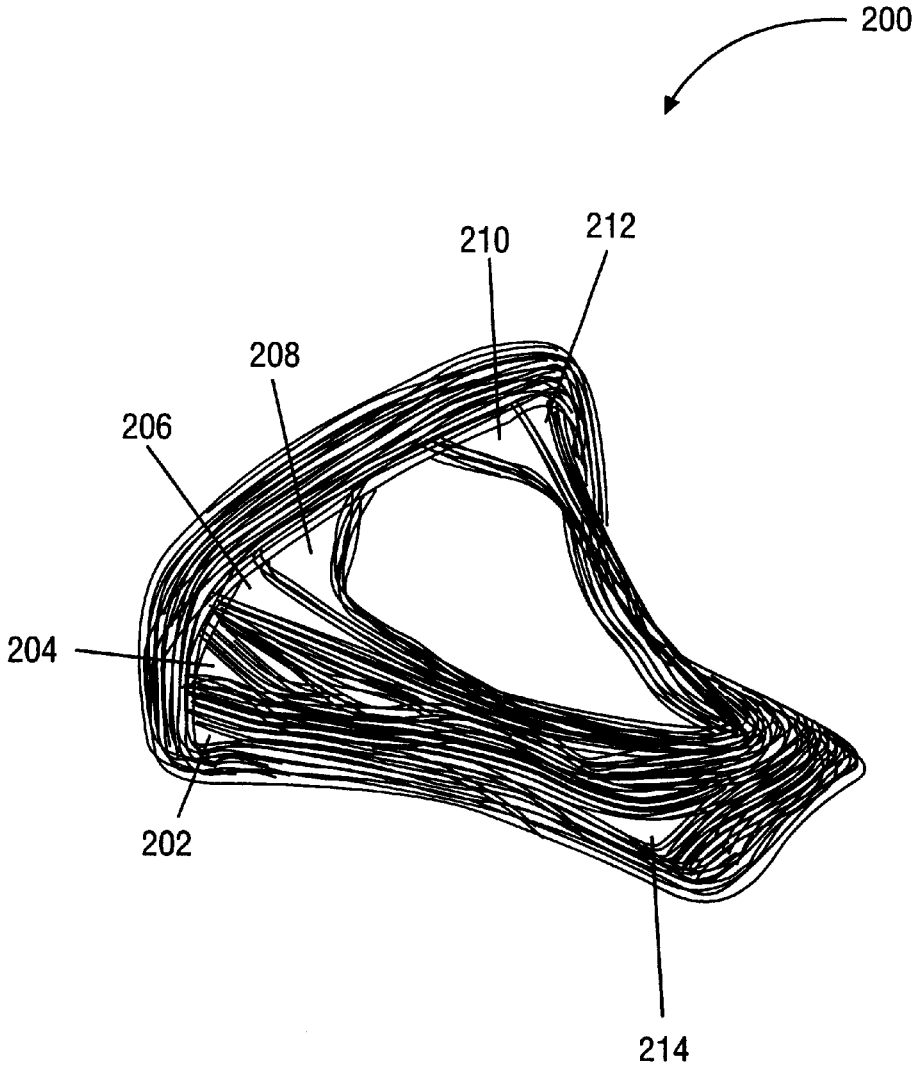
FIG. 2 (PRIOR ART)
FIG. 2 is a diagrammatic perspective view of another conventional saddle-type deflection coil having a number of gaps formed during a winding process.
Figure 3:
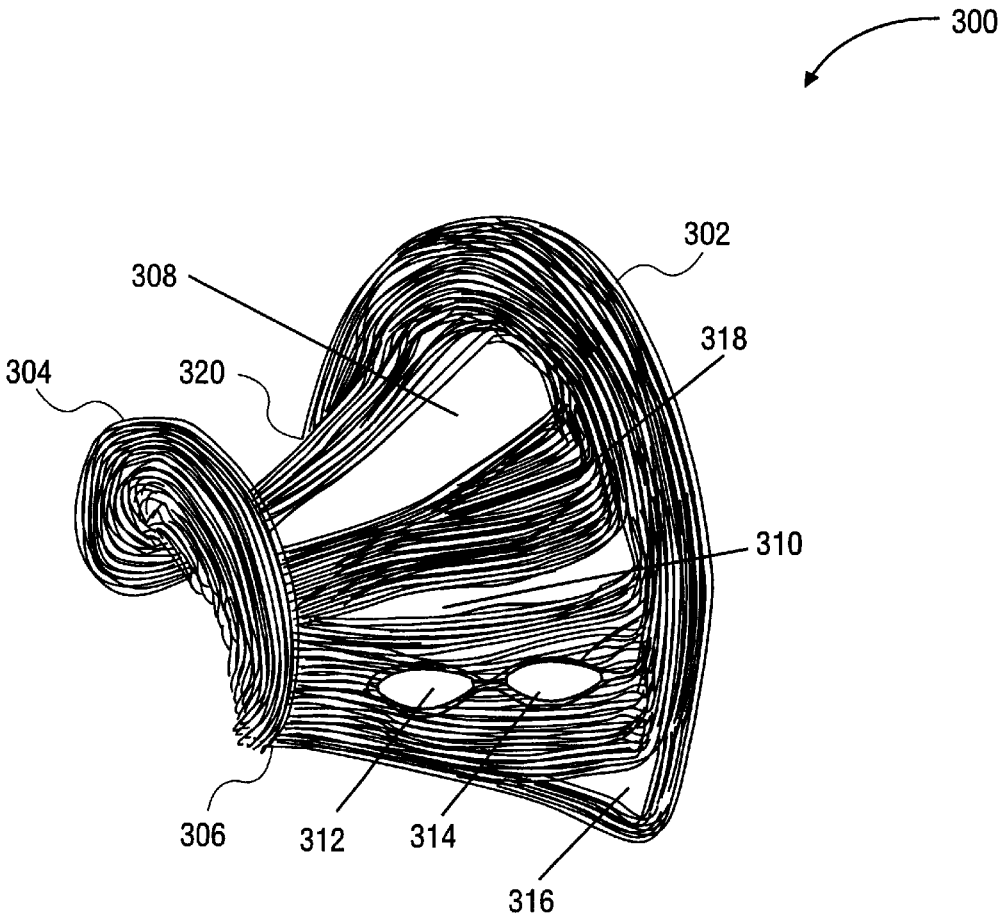
FIG. 3 is a diagrammatic perspective view of a saddle-type deflection coil constructed in accordance with one embodiment of the invention.

FIG. 3 depicts one example of a saddle-type deflection coil 300 constructed according to the invention. The illustrated deflection coil 300 comprises a front flare portion 302, a rear flare portion 304, a neck region 306 and a central opening 308 and a number gaps 310–316 formed in winding regions 318 and 320 between the front and rear flare portions. The deflection coil 300 may be formed by using a winding machine and a coil-winding die to wrap a wire into a saddle shape. Then, gaps are formed in the windings subsequent to the winding process in accordance with one aspect of the invention. In accordance with another aspect of the invention, instruments having shaped ends are used to create gaps of various sizes and shapes along various locations in the coil windings. The number, location and shape of gaps in the deflection coil are selected by a design engineer to obtain a desired magnetic field.

Figure 4:
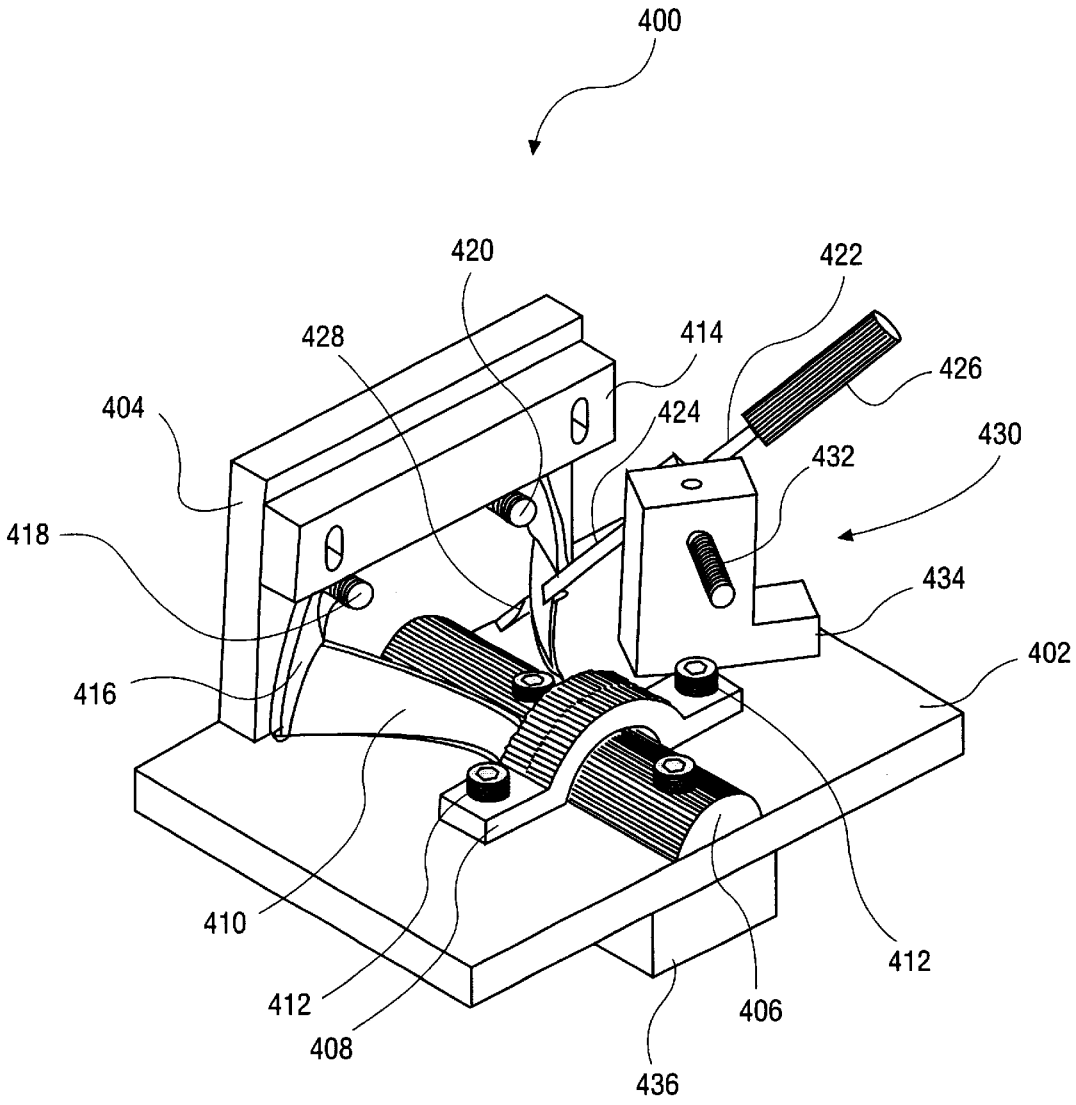
FIG. 4 is a diagrammatic perspective view of an apparatus for inducing gaps into a deflection coil according to one embodiment of the invention.

FIG. 4 depicts an apparatus 400 for forming gaps into a deflection coil 410 according to one embodiment of the invention. The apparatus includes a base 402 which may be any structure that provides a stable surface from which to support and work on a deflection coil 410. Mounted to the base 402 are a vertical support 404, a coil support 406 and a coil clamp 408. The coil support 406 is configured to support and restrict the deflection coil 410 from moving laterally along the base 402. In the illustrated embodiment, the coil support 406 is of a semi-cylindrical configuration to support the neck region of the deflection coil 410. However, the coil support 406 can be of any other configuration capable of restricting the deflection coil 410 from moving laterally along the base 402. The deflection coil 410 may be secured to the base 402 by placing the coil clamp 408 over the neck region of the coil and fastening bolts 412 through the coil clamp 408 into the base 402.

A vertical clamp 414 is mounted on the vertical support 404. The vertical clamp 414 includes an extended lip that may be lowered over a front flare portion 416 of the coil 410 so as to sandwich the front flare portion between the vertical clamp 414 and vertical support 404. The front flare portion 416 of the deflection coil 410 can be secured to the apparatus 400 by tightening support pins 418, 420 into the vertical support 404 to wedge the front flare portion 416 between the extended lip and the vertical support 404.

As shown in FIG. 4, a gap-forming instrument 422 is used to facilitate formation of a gap in coil windings. In the illustrated embodiment, the instrument 422 includes an elongated rod 424 having a handle 426 on one end and a gap-forming portion 428 on the other end. The gap-forming portion 428 of the instrument has a cross sectional profile that influences the shape of gap placed into the coil 410. The cross sectional profile of the gap-forming portion may be any desired shape to provide a desired gap shape. For example, the cross sectional profile of the gap-forming portion may be resemble one of a circle, a rectangle, a diamond, an oval, a long slit or any other suitable shape. By enabling a design engineer to select from different shapes of gaps to be created in a deflection coil, this provides the design engineer with greater flexibility in achieving an optimal magnetic field provided by the deflection coil.

To aid in parting of coil windings, the coil is heated prior to the insertion of the gap-forming instrument to a temperature at which the bonding or adhesive material disposed about the conductive wire starts to melt but not so high that the heat starts to damage the insulation layer of the wire. In one implementation, the gap-forming portion 428 has a tapered rounded end to facilitate insertion of the instrument 422 in the coil windings without damaging the insulation layer of the wire.

To help guide the gap-forming portion 428 of the instrument 422 into a particular location in the windings, an instrument guide assembly 430 is incorporated in the apparatus 400. The instrument guide assembly 430 comprises an instrument guide 432 and a guide holder 434. In the illustrated embodiment, the guide holder 434 includes an L-shaped member movably attached to the base 402 to permit the entire guide holder 434 to slide over the top surface of the base and rotate with respect to the base. The guide holder 434 includes one or more fastener (not shown) to secure the holder 434 to the base 402 in a selected position. The probe guide 432 includes an elongated element pivotally coupled to the guide holder 434. The probe guide 432 has a bore to enable the instrument 422 to move longitudinally with respect to the bore. The probe guide 432 also includes a fastener (not shown) to secure the probe guide at a selected pivotal angle with respect to the guide holder 434. In this regard, the instrument guide assembly 430 is useful in remembering the location of a gap during subsequent gap forming process.

While only one instrument, one instrument guide and one guide holder are shown for the illustrated embodiment, it will be appreciated by those skilled in the art that the apparatus 400 can accommodate a number of instrument guide assemblies to systematically form multiple gaps in the deflection coil to achieve any complex and intricate coil pattern.

The illustrated apparatus 400 also includes a vice holder 436 attached to bottom of base 402. The vice holder 436 may be an extension of base 402 that may be disposed between two jaws that, when closed, securely hold the base 402 in position.

Figure 5:
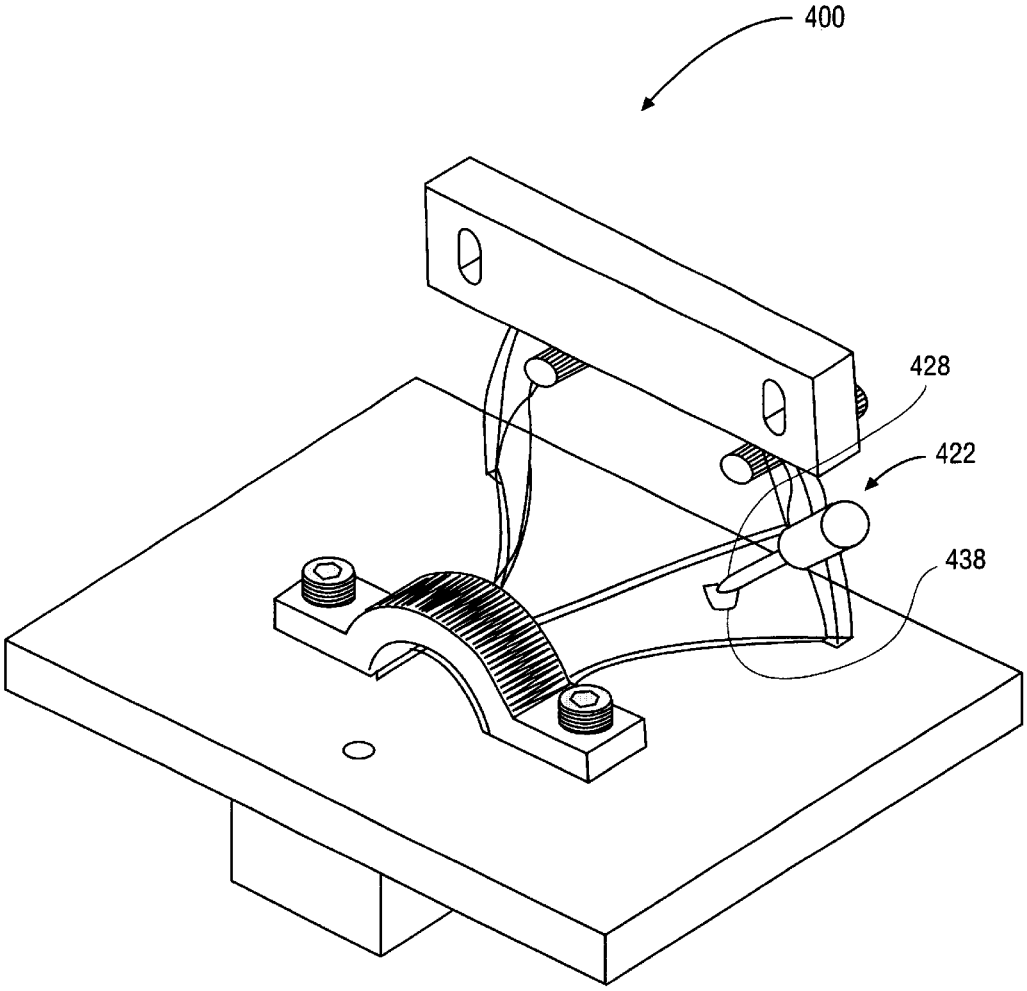
FIG. 5 is a diagrammatic perspective view of the apparatus of FIG. 4 with some components removed.

FIG. 5 depicts the apparatus 400 of FIG. 4 with some components removed from the illustration for clarity. As noted above, the shape of gap 438 may be influenced by the cross sectional profile of a gap-forming portion 428 of a gap-forming instrument 422. In the illustration shown, the gap 438 defines a trapezoid shape produced with an instrument 422 having a trapezoid shape gap-forming portion 428.

By forming at least some or all of the gaps in the coil windings subsequent to the winding process, a number of advantages are provided by the present invention. For example, because the number of gaps formed during a coil winding process using pin insertions is significantly reduced or totally eliminated, a coil winding machine is able to complete its winding task in a much quicker fashion. In addition, the cost of developing a coil-winding die and winding machine is significantly reduced, since the present invention eliminates or minimizes the need to have complicated pin insertion mechanisms as part of the coil-winding die and winding machine. Moreover, the present invention allows for a variation in hole location and number of holes as part of designing process during a deflection coil designing stage. Furthermore, unlike conventional techniques, the present invention advantageously permits introduction of gaps in the coil windings of a wide variety of shapes and sizes, such as long slits and oval holes as shown in FIG. 3.

Figure 6:
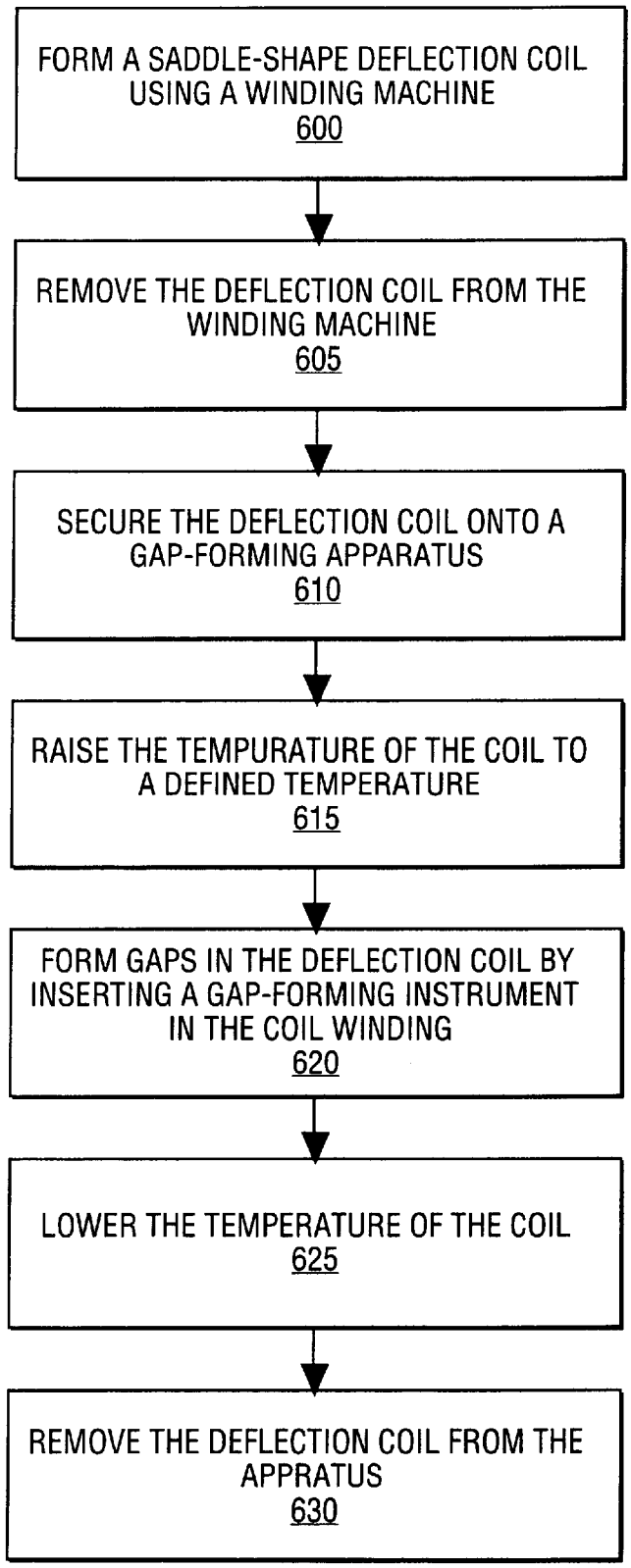
FIG. 6 is a flowchart of operations of forming a saddle-type deflection coil according to one embodiment of the invention.

FIG. 6 depicts operations of forming a saddle-type deflection coil according to one embodiment of the invention. In block 600, a winding machine and a coil-winding die are used to form a saddle-shaped deflection coil. Then in block 605, the deflection coil is removed from the winding machine and coil-winding die. Then in block 610, the deflection coil is secured to a gap-forming apparatus 400 by placing the coil over a coil support 406 and with the front flare portion of the coil touching a vertical support 404. By using a combination of a coil clamp 408 and a vertical clamp 414, the coil may be securely supported by the apparatus. Specifically, the coil clamp 408 is used to secure the neck region of the coil to the base 402 and the vertical clamp 414 is used to secure the front flare portion to the vertical support 404.

To facilitate separation of the coil windings upon insertion of the instrument, heat is applied to raise the temperature of the coil to soften or to melt the adhesive material bonding the coil windings together. Heat can be applied to the coil either before the coil is secured to the gap forming apparatus 400 or after the coil has been secured to the apparatus 400. The heating of the coil can be accomplished by directing heat from an external source such as a hot air gun or by placing the coil in an oven. Alternatively, electrical power can be applied to the coil to provide heat generated by the electrical power. In one embodiment, the coil is heated to a temperature above the softening point or melting point of the adhesive coating but below a temperature that would damage insulation layer of the conductive wire. In one implementation, the coil is heated to a temperature which may range from about 130 to 160 degrees Celsius, and preferably about 150 degrees Celsius.

After the coil has been heated to a proper temperature range, the gap-forming portion 428 of the instrument 422 is inserted in the coil windings, in block 620, to form a gap. This can be accomplished by moving the instrument through the bore of the guide 432. Then in block 625 the coil is allowed to cool to a rigid construction before the coil is removed from the apparatus in block 630.

In one embodiment, the gap-forming portion 428 of the instrument 422 is manually inserted into the coil windings using the apparatus 400 described above. In an alternative embodiment, the process of creating gaps in a deflection coil is automated by a machine that controls insertion of a number of gap-forming instruments. The machine may be configured to create all gaps in the coil at the same time or may be configured to create gaps in certain order.

When desired, the location of the gap formed in the coil winding can be changed by simply adjusting the orientation of the instrument 422 with respect to the coil supported by the apparatus 400. This may involve sliding the guide holder 434 over the top surface of the base 402, adjusting the vertical pivot angle of the instrument 422 by rotating the probe guide 432 with respect to the guide holder 434, and adjusting the horizontal pivot angle of the instrument 422 by rotating the guide holder 434 with respect to the base 402. Once the instrument is in a desired position, the guide holder 434 and instrument guide 432 is fixed in place by tightening fasteners. By using the instrument guide 432 and the guide holder 434 to maintain the instrument 422 in certain orientation with respect to the deflection coil, the insertion of the instrument head (e.g., gap-forming portion) into a precise location in the windings can be subsequently repeated.

While the foregoing embodiments of the invention have been described and shown; it is understood that variations and modifications, such as those suggested and others within the spirit and scope of the invention, may occur to those skilled in the art to which the invention pertains. The scope of the present invention accordingly is to be defined as set forth in the appended claims.

What is claimed is:

1. A deflection coil comprising:

at least one conductive wire having an insulation layer and an adhesive coating disposed about said insulation layer wound in a plurality of winding turns to form a saddle-shaped coil, said saddle-shaped coil including a front flare portion, a rear portion, and at least one winding region extending between said front and rear portions; and wherein said at least one winding region having a plurality of gaps formed therein, wherein at least one of said plurality of gaps is formed subsequent to a winding process.

2. The deflection coil of claim 1, wherein said deflection coil is continuously wound during said winding process without interruptions from pin insertions.

3. The deflection coil of claim 1, wherein said at least one of said plurality of gaps formed subsequent to the winding process is formed by using a gap-forming instrument.

4. The deflection coil of claim 1, wherein said at least one of said plurality of gaps in said deflection coil has an oval shape.

5. The deflection coil of claim 1, wherein at least one of said plurality of gaps in said deflection coil has an elongated slit shape.

6. The deflection coil of claim 1, wherein each of said plurality of gaps is heated with a different shape to achieve a desired magnetic field.

7. A deflection coil comprising:

at least one conductive wire wound in a plurality of winding turns to form a coil, said coil including a front flare portion, a rear portion, and at least one winding region extending between said front portion and said rear portion; and wherein said at least one winding region having a plurality of gaps formed therein, wherein at least one of said plurality of gaps is formed subsequent to a winding process.

8. A deflection coil comprising:

at least one conductive wire having an insulation layer and an adhesive coating disposed about said insulation layer wound in a plurality of winding turns to form a saddle-shaped coil having a predetermined shape, said saddle-shaped coil including a front flare portion, a rear portion, and at least one winding region extending between said front portion and said rear portion; and a plurality of gaps formed within said at least one winding region therein, at least one of said plurality of gaps is formed subsequent to a winding process that produces the coil.

* * * * *